US005927372A

United States Patent [19]

Moribe et al.

[11] Patent Number: 5,927,372

[45] Date of Patent: Jul. 27, 1999

[54] METHOD OF SUPPLYING SAND TO BLOW HEAD OF BLOW MOLDING MACHINE

[75] Inventors: Yasuo Moribe, Gamagoori; Takayuki Komiyama, Shinshiro, both of Japan

[73] Assignee: Sintokogio, Ltd., Nagoya, Japan

[21] Appl. No.: 08/973,330

[22] PCT Filed: Mar. 27, 1997

[86] PCT No.: PCT/JP97/01056

§ 371 Date: Mar. 16, 1998

§ 102(e) Date: Mar. 16, 1998

[87] PCT Pub. No.: WO97/37790

PCT Pub. Date: Oct. 16, 1997

[30] Foreign Application Priority Data

Apr. 5, 1996 [JP] Japan ..... P08-110495

[51] Int. Cl.[6] ..... B22C 15/24

[52] U.S. Cl. ..... 164/20; 164/21

[58] Field of Search ..... 164/20, 19, 21, 164/22

[56] References Cited

U.S. PATENT DOCUMENTS

| | | | |
|---|---|---|---|
| 3,089,207 | 5/1963 | Miller | 164/22 |
| 3,730,250 | 5/1973 | Fellows | 164/22 |
| 5,246,058 | 9/1993 | Murata | 164/182 |
| 5,291,936 | 3/1994 | Rommel et al. | 164/22 |

FOREIGN PATENT DOCUMENTS

| | | |
|---|---|---|
| 53-17083 | 6/1978 | Japan . |
| 53-17084 | 6/1978 | Japan . |
| 5-277635 | 10/1993 | Japan . |
| 7-16705 | 1/1995 | Japan . |

*Primary Examiner*—J. Reed Batten, Jr.
*Attorney, Agent, or Firm*—Limbach & Limbach L.L.P.

[57] ABSTRACT

Before supplying molding sand into the blow head, a blow-in port of the mold-defining device is connected to a blow-off port of the blow head so that molding sand flowing out of the blow-off port is received by the device after the molding sand has been supplied to the blow head. Preferably, after molding sand has been charged into the mold space but before the mold-defining device is moved out of engagement with the blow head, sand remaining in the blow-off port is hardened.

2 Claims, 2 Drawing Sheets

METHOD OF SUPPLYING SAND TO BLOW HEAD OF BLOW MOLDING MACHINE

TECHNICAL FIELD

This invention relates to a method of blow charging molding sand by means of compressed air into a blow head of a blow type molding machine.

BACKGROUND ART

In a conventional blow type molding machine where molding sand is blow charged by means of compressed air into a device that defines a mold space, a part of the molding sand flows out of the blow-off port, which is mounted on the lower part of a blow head, when the mold sand is supplied in the empty blow head, and is scattered outside, thereby contaminating the working environment.

This invention was created to resolve this drawback. Its purpose is to provide a method of supplying molding sand into a blow head wherein the molding sand which flows out of a blow-off port is prevented from being scattered when it is supplied to the blow head.

SUMMARY OF THE INVENTION

To this end, in the method of the present invention of blow charging molding sand into a blow head of a blow type molding machine, a blow-in port is connected to a blow-off port before supplying molding sand into the blow head, so that a device that defines a mold space can receive a part of the molding sand which flows out of the blow-off port of the blow head when the molding sand is supplied into the blow head. Thus the part of the molding sand flowing out of the blow-off port is not scattered in the environment.

PREFERRED EMBODIMENT OF THE INVENTION

Figure 1:
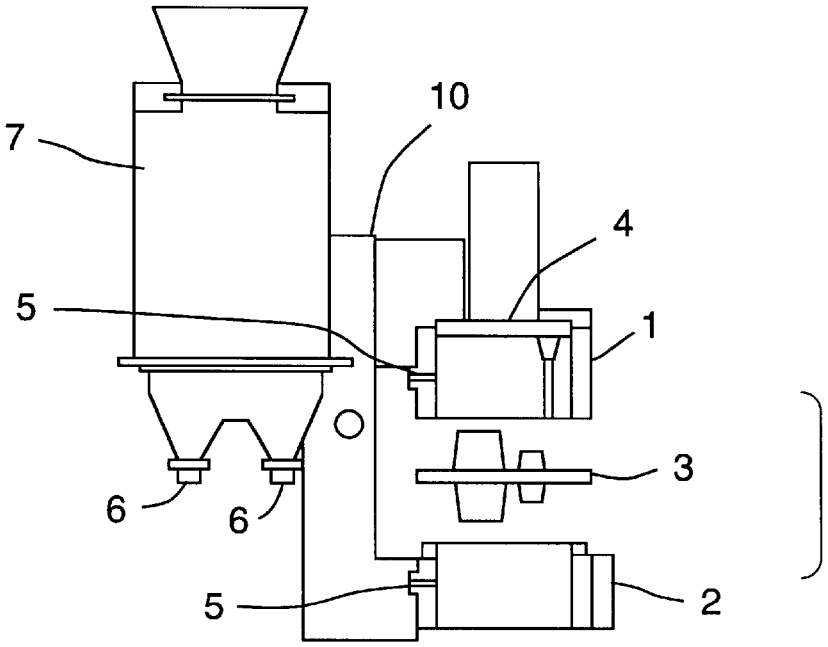
FIGS. 1–4 are explanatory drawings to show the steps of the present invention using a molding machine suitable to execute this invention.
Figure 2:
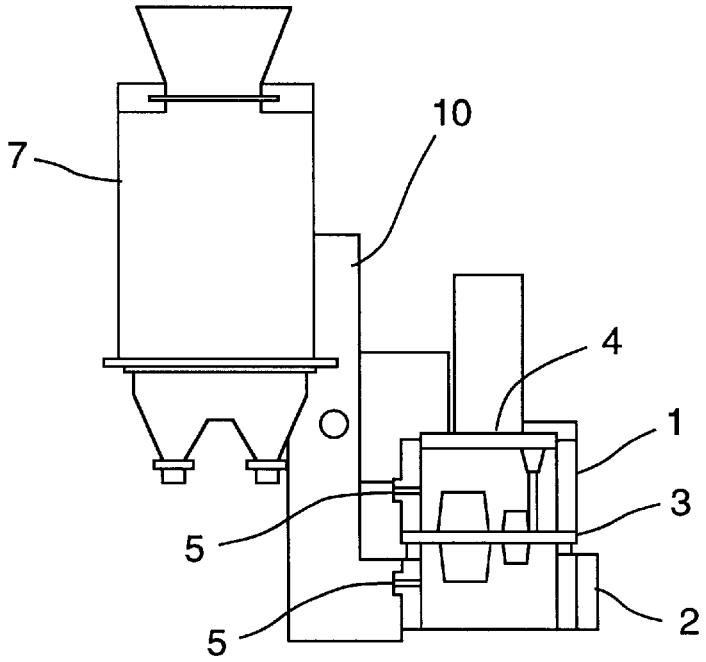
Figure 3:
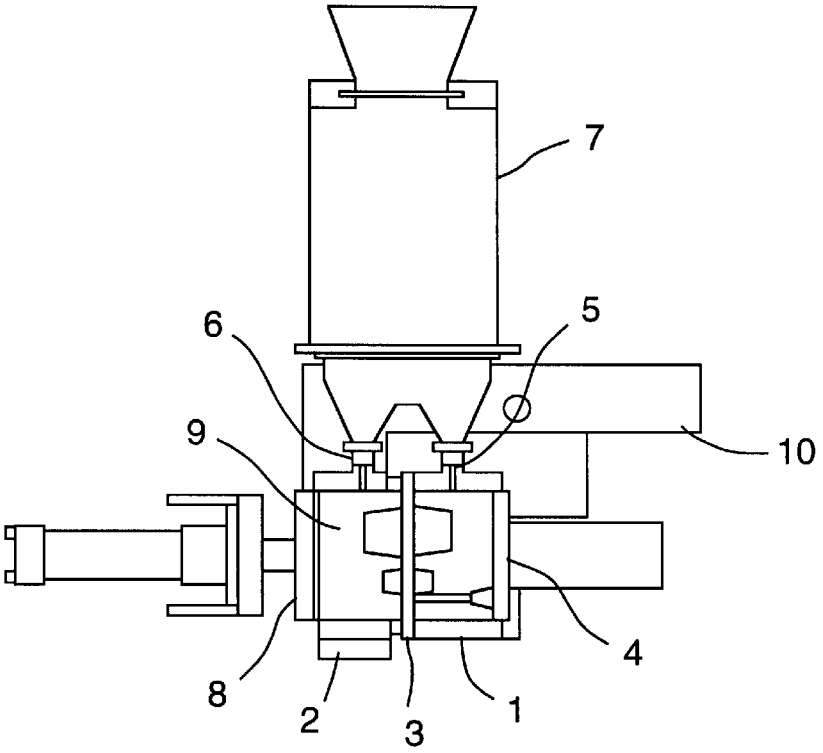

By reference to FIGS. 1–4 the preferred embodiment of the present invention is now explained. As shown in FIG. 1, a match plate 3 is introduced between an upper flask 1 and a lower flask 2. Then, as shown in FIG. 2, the upper flask 1, the match plate 3, and an upper squeeze plate 4, are lowered to superimpose the match plate 3 and upper flask 1 on the lower flask 2. Then, as shown in FIG. 3, the superimposed upper and lower flasks 1, 2 and match plate 3 are rotated by a rotary device 10 through 90° about a horizontal axis of rotation to connect two blow-in ports 5, 5 of the upper and lower flasks 1, 2 with blow-off ports 6, 6 of a blow head 7, and a lower squeeze plate 8 is inserted just a little into an end opening of the lower flask 2. A device that defines a mold space, comprising the upper and lower flasks 1, 2, match plate 3, and upper and lower squeeze plates 4, 8, defines a mold space 9.

Figure 4:
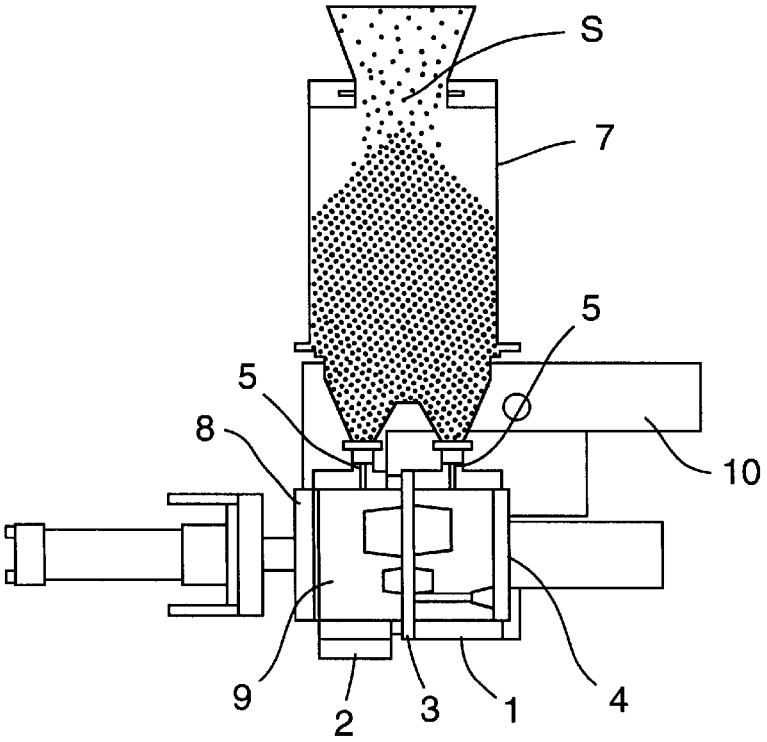

As shown in FIG. 4, a predetermined amount of molding sand S is then supplied into the empty blow head 7. Although a part of the molding sand S flows out of the blow-off ports 6, 6 of the blow head 7, it enters the device (i.e., mold space 9) through the blow-in ports 5, 5. Thus it is not scattered outside the blow-off ports. Compressed air is then supplied into the blow head 7 by a known means (not shown) to blow the molding sand in the blow head 7 into the mold space, and the molding sand in the mold space is then squeezed by the upper and lower squeeze plates 4, 8. Thus a cope and a drag are produced by this molding machine in the normal molding operation.

After a mold is produced in this way, since to some degree the molding sand in the blow-off ports of the blow head 7 is hardened, it blocks the ports. Therefore, the molding sand in the blow head 7 does not flow out unless compressed air is supplied into it. Thus, after the first mold is produced, molding sand does not flow out when it is supplied to the blow head 7.

It is understood by those skilled in the art that the embodiment is exemplary, and this invention can be carried out in other modified forms without departing from the scope of the claims of the invention attached to this specification.

We claim:

1. A method of supplying molding sand to a blow head having blow-off ports, so that the molding sand can later be blown from the blow head through the blow-off ports into a device that defines a mold space, through at least one blow-in port of the device, wherein the device comprises a substantially straight member rotatably supported on a rotatable mount, the member has a first flask at one end thereof and a second flask at the other end thereof, the first flask and the second flask are configured to engage each other to define the mold space, and each of the first flask and the second flask has a blow-in port at one side thereof, said method comprising the steps of:

placing the blow head in a predetermined position when the blow head is empty and has not been fed with the molding sand;

disposing the member in a vertical position at one side of the blow head;

engaging the first flask with the second flask, thereby defining the mold space so that said mold space communicates with each said blow-in port;

rotating the member through ninety degrees in a horizontal plane, thereby engaging each said blow-in port with a different one of the blow-off ports; and after the engagement, introducing a predetermined amount of the molding sand into the blow head.

2. A method of producing a mold by blowing molding sand from a blow head into a device that defines a mold space, through blow-off ports of the blow head and at least one blow-in port of the device, wherein the device comprises a substantially straight member rotatably supported on a rotatable mount, the member having a first flask at one end thereof and a second flask at the other end thereof, the first flask and the second flask are configured to engage each other to define the mold space, and each of the first flask and the second flask has a blow-in port at one side thereof, said method comprising the steps of:

(a) placing the blow head in a predetermined position when the blow head is empty and has not been fed with the molding sand;

(b) disposing the member in a vertical position at one side of the blow head;

(c) engaging the first flask with the second flask, thereby defining the mold space so that said mold space communicates with each said blow-in port;

(d) rotating the member through ninety degrees in a horizontal plane, thereby engaging each said blow-in port with a different one of the blow-off ports;

(e) after step (d), introducing a predetermined amount of the molding sand into the blow head, the predetermined amount at least substantially equaling an amount that fills the mold space and the blow-off ports;

(f) after step (e), introducing compressed air into the blow head, thereby charging the predetermined amount of the molding sand into the mold space and the blow-off ports;

(g) after step (f), hardening the molding sand in the blow-off ports so that the molding sand in the blow-off ports does not drop freely; and (h) after step (g), moving the member out of engagement with the blow head.

* * * * *